United States Patent [19]

Smith

[11] 4,446,994

[45] May 8, 1984

[54] CONTAINER WITH FLEXIBLE POURING SPOUT AND SEALING CLOSURE

[76] Inventor: Wallace E. Smith, 61 Meadow Brook Cir., Sudbury, Mass. 01776

[21] Appl. No.: 411,898

[22] Filed: Aug. 26, 1982

[51] Int. Cl.[3] ..... B65D 47/10

[52] U.S. Cl. ..... 222/475; 222/528; 222/530; 222/541

[58] Field of Search ..... 222/526, 527, 528, 530, 222/538, 541, 465, 475, 529

[56] References Cited

U.S. PATENT DOCUMENTS 2,770,399 11/1956 Gross ..... 222/530
2,957,614 10/1960 Krajcovic ..... 222/530
3,181,743 5/1965 Libit et al. ..... 222/528
3,993,223 11/1976 Welker et al. ..... 222/541 X

*Primary Examiner*—F. J. Bartuska
*Attorney, Agent, or Firm*—Richard P. Crowley

[57] ABSTRACT

A disposable, plastic container for the dispensing of liquids, which container comprises: an elongated, flexible collapsible nozzle; a removable top handle having an open area; and a raised sealing nipple on the top exterior surface of the container, whereby, on opening of the container by removal of the handle, the container is resealed by bending the nozzle to form a seal, along a line of collapse of the nozzle the bent nozzle retained in a sealing position by the handle placed about the base of the nozzle, and the outlet of the nozzle placed in a sealing engagement with the sealing nipple on the container to provide a dual seal for the container.

15 Claims, 5 Drawing Figures

CONTAINER WITH FLEXIBLE POURING SPOUT AND SEALING CLOSURE

BACKGROUND OF THE INVENTION

This invention relates to disposable containers and in particular plastic containers which have a flexible, collapsible, pouring nozzle and an improved means of effecting closure of the container after use.

Containers for the storing and dispensing of liquids have been employed containing a variety of collapsible pouring spouts or nozzles, in order to dispense the liquid ingredients in the container. Such containers, containing collapsible pouring spouts, also include means to effect resealing of the container after use. Typically, such containers are shown, for example, in U.S. Pat. No. 2,792,976, wherein a cap or other means are employed to seal the container after opening. U.S. Pat. No. 3,743,144 describes a reclosable, caulking cartridge container having a nozzle which permits the cutting of the spout and using a portion thereof to overfit the spout to reseal the cartridge. U.S. Pat. No. 4,066,190 describes a reclosable, dispensing container which employs a nestable dispensing spout, while U.S. Pat. No. 4,318,403 is directed to a syringe-like container having an elongated discharge nozzle which is flexible, to facilitate bending and folding of the nozzle in the groove along the side of the container. Flexible, elongated spouts are employed, therefore, in the prior art, to aid in dispensing the material, and such elongated spouts must be resealed effectively after use.

Dispensing containers also contain sealing caps and often such containers include means to remove a portion of the original seal and to employ the cap or seal to reseal the container, such as, for example, as illustrated in U.S. Pat. Nos. 3,187,966; 3,993,223; and 3,204,835.

SUMMARY OF THE INVENTION

This invention is directed to a container having a collapsible, elongated nozzle for dispensing materials in the container and to seal effectively the container after use. In particular, the present invention concerns a flexible, lightweight, plastic, disposable container containing an integral breakaway top handle element, and which container provides for a multiple sealing mechanism to eliminate spillage after opening of the container.

The container of the present invention comprises a flexible, lightweight, plastic, disposable container characterized by an elongated nozzle or pouring spout which is flexible and which, after opening, may be sealed by collapsing or bending over the elongated nozzle, to effect a seal of the open container along a closure line, where the nozzle is bent over or collapsed. Further, the plastic container of the invention provides for an initial, integral, breakaway, top-handle mechanism which is usefully employed after removal, to retain the elongated, flexible nozzle in a sealing position and to permit the end of the elongated nozzle to fit into a seal, at the outlet of the nozzle, integral with the container, so as to effect a double seal of the flexible container after opening. The container of the invention thereby effectuates a seal, both by bending over along a line of nozzle collapse and by closing the discharge outlet of the elongated nozzle in a sealing engagement with a seal on the exterior surface of the body of the container.

The container of the invention, in its dual, sealed condition, also provides an easy and convenient method for the user to carry the container, since the flexible, elongated nozzle, in the sealing condition, forms a handle-carrying, closed loop. Typically, the container is formed of a lightweight, sterilizable, if required, nonbreakable, plastic, such as a thermoplastic, such as polyethylene or polypropylene, which may be blow-molded or extruded to the desired form, shape and size by conventional techniques. The container may be employed for the storing and dispensing of pourable materials, such as powders, or particularly liquids, such as water or beverages or nonedible liquids, such as oil, gasoline, or other liquids, particularly where it is desirable to employ elongated nozzles for the proper directional dispensing of the liquid in the container. The container of the invention is particularly useful for use by athletes or persons engaged in sporting events, since the container is flexible, nonbreakable, lightweight, plastic and disposable and is easily opened, double-sealed and carried and may be of convenient size and is inexpensive in cost. The container is compact and easy to transport before or after opening.

The container of the invention comprises a plastic container having a body portion thereof in which a material to be dispensed is disposed. The container has an elongated, flexible nozzle section secured to the body, such as by a sealed, threadable attachment at the base of the nozzle to the top outlet of the body. The elongated nozzle section is adapted to dispense the material from the body portion through a discharge opening or outlet at the one upper end thereof and is capable of being folded or bent over, so as to form a liquid-tight seal along the line of bending, when, for example, the flexible nozzle is bent to about greater than 90°; for example, 90° to 170°.

The container includes a top handle element typically integrally molded or formed with the one end of the elongated nozzle, so that it may be broken off, such as by manual twisting by the user, or removed easily from the discharge end of the flexible nozzle, such as by a threadable, snap-fit or other liquid-tight connection. The top handle element, prior to opening of the container, serves to seal the container and may, in one embodiment described, also serve as a handle for carrying the container. The handle element is characterized by an open section therein which is adapted to fit over the elongated, flexible nozzle and rest, in a retaining position, about and on the base thereof. The handle element also contains means to retain the upper end of the flexible nozzle in the bent-over or sealed condition after opening of the container.

The container also comprises a sealing means usually positioned on the exterior surface of the body portion of the container, typically an integral, raised, rounded, sealing nipple, which is designed to be positioned on the upper portion of the body and to fit in a close, liquid-tight, mating and sealing engagement with the open discharge outlet of the flexible nozzle, when the nozzle is in the bent-over, sealing position. The upper end of the bent nozzle is retained in the bent, sealed condition by the top handle element and typically by the upper end of the nozzle placed through a small opening in the handle element.

After opening of the container by the user and in the sealing position, the flexible container is sealed both by the bending or collapsing of the elongated nozzle across the nozzle diameter or also by a line of weakness therein and the sealing means at the discharge outlet end of the bent nozzle. In this arrangement also, the elongated nozzle forms a closed loop with the exterior surface of the body, so that the container, after opening and being sealed, may be carried easily by the handle-like loop. Prior to opening the container, the top handle element, with its open portion thereof, may be employed as a handle. The top handle element is characterized in one embodiment by an open section formed and designed to fit over the elongated nozzle and to sit about the lower base section thereof, and to provide another open section thereof, into which or through which the upper end of the elongated nozzle may be positioned, to hold the nozzle in the sealing position and to position the bent nozzle, so that the outlet may engage the sealing, raised nipple on the exterior surface of the container.

In one embodiment, the top breakoff handle element comprises a relatively large open area which serves as a handle and which also is so contoured so as to fit over the elongated nozzle and about the base of the nozzle, and into a retaining groove on the base of the elongated nozzle, so that the handle element is securely retained about the base. The base of the nozzle has a ring indentation to hold the handle element in a snug, snap-fit position. The handle element has another smaller open section into which and through which the open, tapered, upper, discharge end of the elongated nozzle may be placed and retained in a sealing position, while the discharge outlet of the bent nozzle is placed in a sealing engagement with the sealing nipple on the container. This arrangement provides for a secure, double seal of the container after opening, and also provides a handle for carrying the container securely.

The disposable, plastic container of the invention will be described for the purpose of illustration only in connection with a particular embodiment; however, it is recognized that various changes, modifications and improvements may be made by persons skilled in the art, all without departing from the spirit and scope of the invention.

DESCRIPTION OF THE EMBODIMENTS

Figure 1:
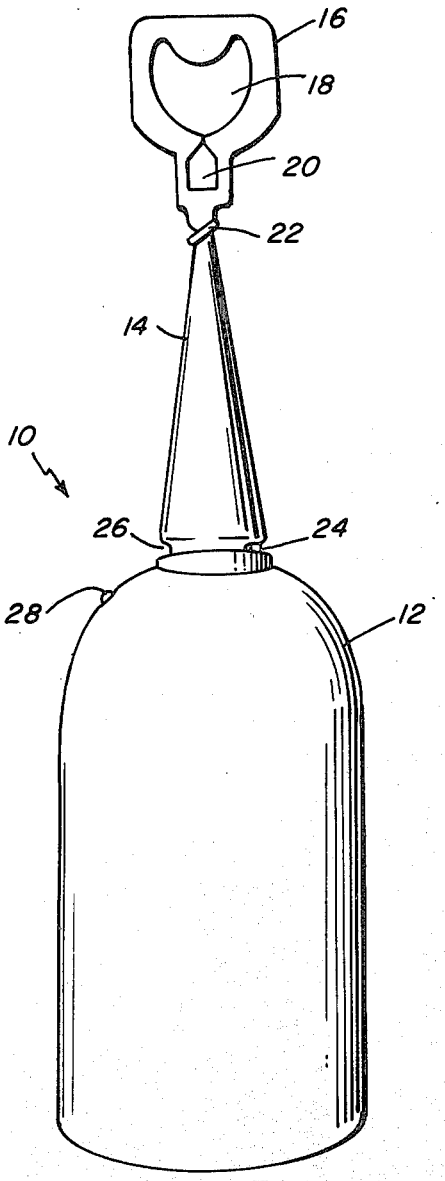
FIG. 1 is a plan side view of the container of the invention.
Figure 2:
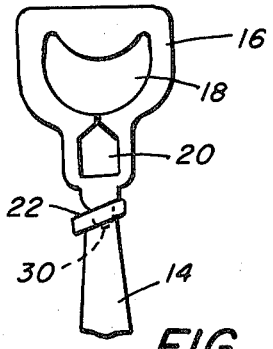
FIG. 2 is a partial sectional, enlarged view of the top handle of the container prior to opening.
Figure 3:
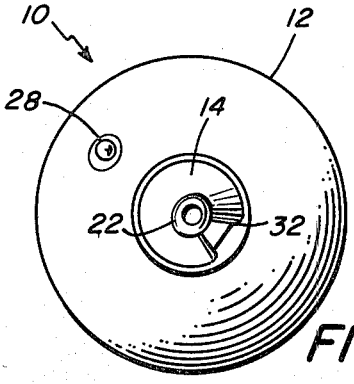
FIG. 3 is a top plan view of the container after the removal of the breakaway top handle.

The drawings show a flexible, plastic, lightweight container 10 which comprises a body section 12 adapted to contain a material, such as a liquid or powder, to be dispensed, and which contains a nozzle 14 comprising an elongated, tapered, conical nozzle formed of a flexible, plastic material and having integrally formed therewith a breakaway handle top 16 characterized by an arcuate, curved, open area 18 and a smaller, polygonal-shaped, open area 20. The top handle 16 is integrally molded with or sealed into a discharge outlet 22 of the elongated nozzle 14, such as by being blow-molded therewith or otherwise formed, so that the handle 16, by twisting by the user, may be broken off to open the discharge outlet 22 at the top of the elongated nozzle 14. The handle 16 on breaking away (see FIG. 2) has an extending, sealing nipple 30 which fits into the discharge outlet 22, to form originally a seal with the top of the nozzle 14.

Figure 4:
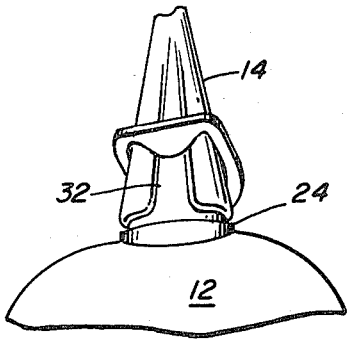
FIG. 4 is a partial enlarged view of the opposite side of FIG. 3 showing the handle in position about the base of the nozzle of the container.

The base of the nozzle comprises a screw-type base 24 adapted to be secured threadedly to a top threaded outlet in the body 12 of the container. The base of the nozzle 14, shown more particularly at FIG. 4, is molded or otherwise contoured to present a pair of upwardly tapered, raised ridges or flanges 32 designed and adapted to fit in a snug manner into the generally arcuate W shape or curvature of the open section 18 of handle 16. The ridges 32 generally form a conical depression extending at least a portion of the way up from the base of the nozzle 14. The body element 12 contains an integral, raised, sealing nipple 28 on the one side thereof and positioned on the body 12 and adapted to receive, in sealing engagement, the circular discharge outlet 22 of the nozzle 14, after the handle 16 has been removed.

Figure 5:
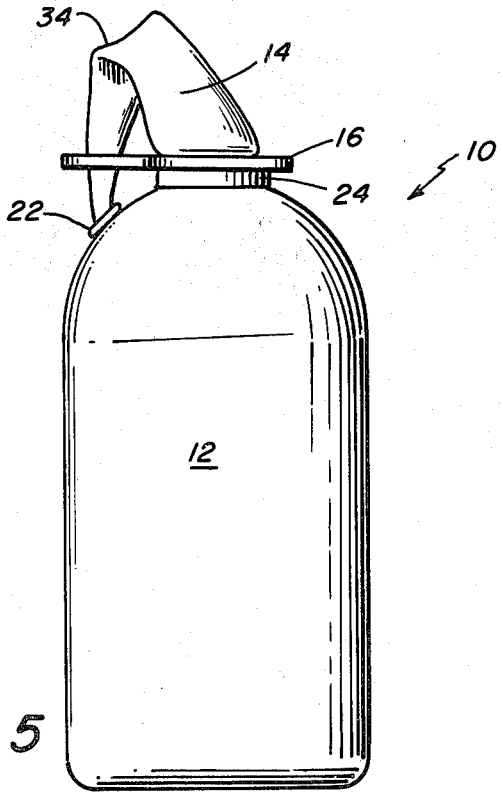
FIG. 5 is a plan side view of the container in a dual-sealed condition.

FIG. 5 is a view of the container 10 wherein the container is placed in the sealing position, wherein the flexible nozzle 14 has been bent over to form a sealing line of weakness 34 which forms a seal of the closure through bending or collapsing of the nozzle 14, and wherein the discharge outlet 22 is placed in sealing engagement in a fluid-tight fit and in mating engagement with nipple 28, so that the container is sealed along sealing line 34, as well as in engagement by the discharge outlet 22 with nipple 28. The bent-over, elongated nozzle 14 provides a loop-type handle for the user after opening of the container. The elongated nozzle 14 is retained in the dual-sealing position, as illustrated more particularly in FIGS. 4 and 5, by slipping the breakaway handle 16 over and about the base of the nozzle 14 and placing the tip of the nozzle through the smaller section 20, to retain the section in position and generally adjacent to the sealing nipple 28. FIG. 4 shows in particular the back side of the blow-molded nozzle element in the sealing condition, with the open area 18 in a retaining position about the lower section on the base of the nozzle 14. In operation, the user, after the container is prefilled, merely breaks away or otherwise removes the handle 16 to expose the open discharge outlet 22, and then slips the open area 18 of the handle 16 over the nozzle 14 and into position about the base of the nozzle element and secured in position about ridges 32. After dispensing the desired amount of contents from the body 12 of the container 10, the user merely bends over the flexible nozzle 14 and inserts the discharge end through the open smaller section 20 of the handle 16 and presses the open end 22 of the sealed nozzle into a sealing engagement with the nipple 28 which securely closes the container. As illustrated and disclosed, the container of the invention provides a flexible, disposable, lightweight, low-cost container having a dual-sealing means and a flexible spout for discharge of the contents in the container.

What is claimed is:

1. A container for dispensing a material from the container, which container comprises in combination:

(a) a body element to contain material to be dispensed from the container;

(b) a nozzle means secured to the body element, which nozzle means comprises an elongated, collapsible nozzle having a discharge outlet at the one end to dispense material from the body element and the other base end thereof secured to the body element;

(c) a sealing means on the exterior of the body element, to provide a seal with the open discharge outlet of the elongated nozzle element; and (d) retaining means having a one end and another end, the one end having a first open area which fits in a snug securing manner about the base end of the nozzle and the other end of the retaining means which retains the nozzle in a collapsed sealing position along a line of collapse in the nozzle and which places the open discharge outlet of the nozzle in a position to form a sealing relationship with the sealing means.

2. The container of claim 1 wherein the sealing means comprises a raised nipple on the top exterior surface of the body element.

3. The container of claim 1 wherein the nozzle comprises a flexible, plastic nozzle characterized by a conical, tapered shape.

4. The container of claim 1 wherein the retaining means is integrally formed with the nozzle means, to form a user breakaway handle element which, on removal, opens the discharge outlet of the nozzle.

5. The container of claim 1 wherein the first open area of the sealing means comprises a contoured shape and the base of the elongated nozzle comprises ridge elements which snugly fit within the contoured shape of the first open area of the retaining means.

6. The container of claim 1 wherein the retaining means comprises a second open area smaller than the first open area and which fits about the one end of the discharge nozzle and positions the open end of the discharge nozzle, generally above the sealing means to permit the open end of the discharge nozzle to be sealingly engaged with a raised nipple on the top exterior surface of the body element.

7. A container for the dispensing of a material from the container, which container comprises:

(a) a body element to retain material therein to be dispensed from the container;

(b) a nozzle means secured to the body element, which nozzle means comprises an elongated, flexible nozzle having a discharge outlet at the one end thereof, and the other end thereof secured to the body element;

(c) sealing means on the exterior of the body element, to provide a seal with the open discharge outlet of the elongated nozzle element; and (d) a handle element secured initially to the discharge outlet of the nozzle element, to seal the discharge outlet, the handle means characterized by an open area therein adapted to fit in a snug, retaining position about the base of the elongated nozzle element, and also containing a means to retain the upper section of the nozzle element in a bent, sealing position, whereby, on removal of the handle means from the container to permit the discharge of material from the body element, the container may be sealed by positioning the open area of the handle element about the base of the elongated nozzle, and bending over the flexible nozzle element and retaining the nozzle element in the bent-over condition by the retaining means in the handle means, and sealing the discharge opening outlet of the bent-over, elongated nozzle with the sealing means on the exterior of the body element.

8. The container of claim 7 wherein the nozzle means comprises an elongated, generally conical-shaped, nozzle element.

9. The container of claim 7 wherein the base of the elongated nozzle element comprises an upwardly extending, raised ridge means, the ridge means adapted to fit in a snug, close-fitting relationship within the open area of the handle means.

10. The container of claim 7 wherein the base of the elongated nozzle means is characterized by an inwardly extending ring cavity, about and in which ring cavity the handle means is retained in position.

11. The container of claim 7 wherein the handle means comprises a plastic, integrally molded handle means on the discharge outlet of the nozzle means, which handle means is adapted to be broken off in use, to provide the open discharge outlet of the nozzle means.

12. The container of claim 7 wherein the retaining means of the handle means is characterized by a second open area through which the upper section of the elongated nozzle is placed in a retaining position in the bent, sealing position.

13. The container of claim 7 wherein the sealing means on the exterior of the body element comprises a raised nipple element adapted to fit in a mating, sealing arrangement with the discharge outlet of the elongated nozzle.

14. The container of claim 7 wherein the open area of the handle means comprises a generally arcuate W shape, the base of the elongated nozzle characterized by a pair of upwardly extending, raised, ridge elements which snugly fit within the arcuate shape of the handle means.

15. A plastic, disposable container for the dispensing of liquids, which container comprises:

(a) a plastic, generally cylindrical body element to retain liquid material to be dispensed;

(b) a nozzle means removably secured to the body element at its lower base, and which comprises an elongated, generally conical-shaped, nozzle element extending upwardly from the body element and composed of a flexible, plastic material, the base of the nozzle means characterized by an inwardly extending, peripheral ring cavity thereabout, and further characterized by a pair of upwardly extending, raised ridges thereon, the nozzle means having a discharge outlet at the one upper end thereof;

(c) a raised nipple positioned on the exterior upper surface of the body element, the raised nipple adapted to mate in a liquid-tight sealing arrangement with the open discharge outlet of the elongated nozzle; and (d) a handle means integrally formed with the top of the elongated nozzle and comprising an arcuate-shaped, open area and a separate, smaller open area, the handle means adapted to be broken off in use, to provide an open discharge outlet of the elongated nozzle at the one end, whereby in use, and after breaking off of the handle means by the user, the arcuate-shaped, open area of the handle means is positioned in a snug, retaining position over the base and the ridges of the elongated nozzle, the elongated nozzle bent over to form a sealing line to seal the container, and the upper end of the bent-over, elongated nozzle placed through the smaller open area of the handle means, and the discharge opening of the bent-over, elongated nozzle placed in a sealing engagement with the sealing nipple on the exterior of the base element, to provide a closed container with dual sealing.

* * * * *